United States Patent [19]

Owens

[11] Patent Number: 4,664,462

[45] Date of Patent: May 12, 1987

[54] CONNECTOR RECEIVING SHROUD FOR PANEL

[75] Inventor: Steven P. Owens, Harrisburg, Pa.

[73] Assignee: AMP Incorporated, Harrisburg, Pa.

[21] Appl. No.: 853,381

[22] Filed: Apr. 16, 1986

Related U.S. Application Data

[63] Continuation of Ser. No. 736,191, May 20, 1985, abandoned.

[51] Int. Cl.[4] ..... H01R 13/627

[52] U.S. Cl. ..... 339/65; 339/126 R

[58] Field of Search ..... 339/65, 66 R, 66 M, 339/125 R, 126 R, 132 R, 132 B, 132 T, 133 R, 133 T, 134

[56] References Cited

U.S. PATENT DOCUMENTS 3,685,001 8/1972 Krafthefer ..... 339/65
3,822,416 7/1974 Haag et al. ..... 339/65
4,124,267 11/1978 Mines et al. ..... 339/125 R
4,173,387 11/1979 Zell ..... 339/196 M

FOREIGN PATENT DOCUMENTS 2638604 2/1978 Fed. Rep. of Germany ... 339/125 R
2812332 10/1978 Fed. Rep. of Germany ..... 339/65

*Primary Examiner*—Gil Weidenfenfeld
*Assistant Examiner*—Gary F. Paumen
*Attorney, Agent, or Firm*—F. Brice Faller; Adrian J. LaRue; David L. Smith

[57] ABSTRACT

Two piece shroud for fixing to a back panel about an aperture therethrough provides latching and aligning means for a mating connector received by a bulkhead connector mounted on the opposite side of the panel. Latches are provided on cantilever sidewalls which pivot about axes parallel to the direction of insertion of the mating connector.

7 Claims, 6 Drawing Figures

CONNECTOR RECEIVING SHROUD FOR PANEL

This application is a continuation of application Ser. No. 736,191 filed May 20, 1985, now abandoned.

BACKGROUND OF THE INVENTION

The present invention relates to a shroud for fixing to one side of a panel about an aperture therethrough, to align and latchably engage a connector mated to a pin header fixed to the other side.

A bulkhead connector is an electrical connector fixed to a panel or bulkhead which receives a mating connector through a aperture in the panel. Such a bulkhead connector is marketed by AMP incorporated as its AMPMODU Feed-Through Pin Header, and the appropriate mating connector is an AMPMODU Shielded MT Receptacle Connector. A ground plane may be assembled between the bulkhead connector and the panel where it is desired to ground the shielding of the mating connector to the panel.

When there is no positive means provided for aligning the mating connector with the aperture, it may be inserted somewhat skewed and misaligned with the pins, subjecting same to damage. Further, the known bulkhead connector retains the mating connector solely by fingers of the ground plane engaging a recess in the shield of the mating connector. A shroud which could be fixed to the panel to provide alignment and positive engagement of the mating connector would be desirable.

U.S. Pat. No. 173,387 discloses a connector receiving shroud for fixing to a panel or the like, the shroud having an elongate entry profiled to closely receive a connector therein for alignment with an array of contacts fixed relative to the panel. It is particularly adapted for fixing about a pin array in a printed circuit board and would not be well suited to panel and bulkhead connector application.

SUMMARY OF THE INVENTION

According to the invention, a connector receiving shroud as described above is adapted for fixing about an elongate aperture in the panel, the entry being a through passage for access to contacts fixed in the aperture. The shroud comprises a first shroud member and a second shroud member, each member comprising an endwall and a pair of parallel sidewalls extending therefrom to define the passage. The sidewalls of the first member have means for latchably engaging the connector therebetween. The sidewalls of the first member act as cantilevers movable relatively apart to release the engaging means.

The inventive shroud, in addition to providing means for positive alignment and latching, is suitable for different size apertures and mating connectors received therein by virtue of being in the form of two members individually mounted to the panel.

DETAILED DESCRIPTION OF THE PREFERRED EMBODIMENT

Figure 1:
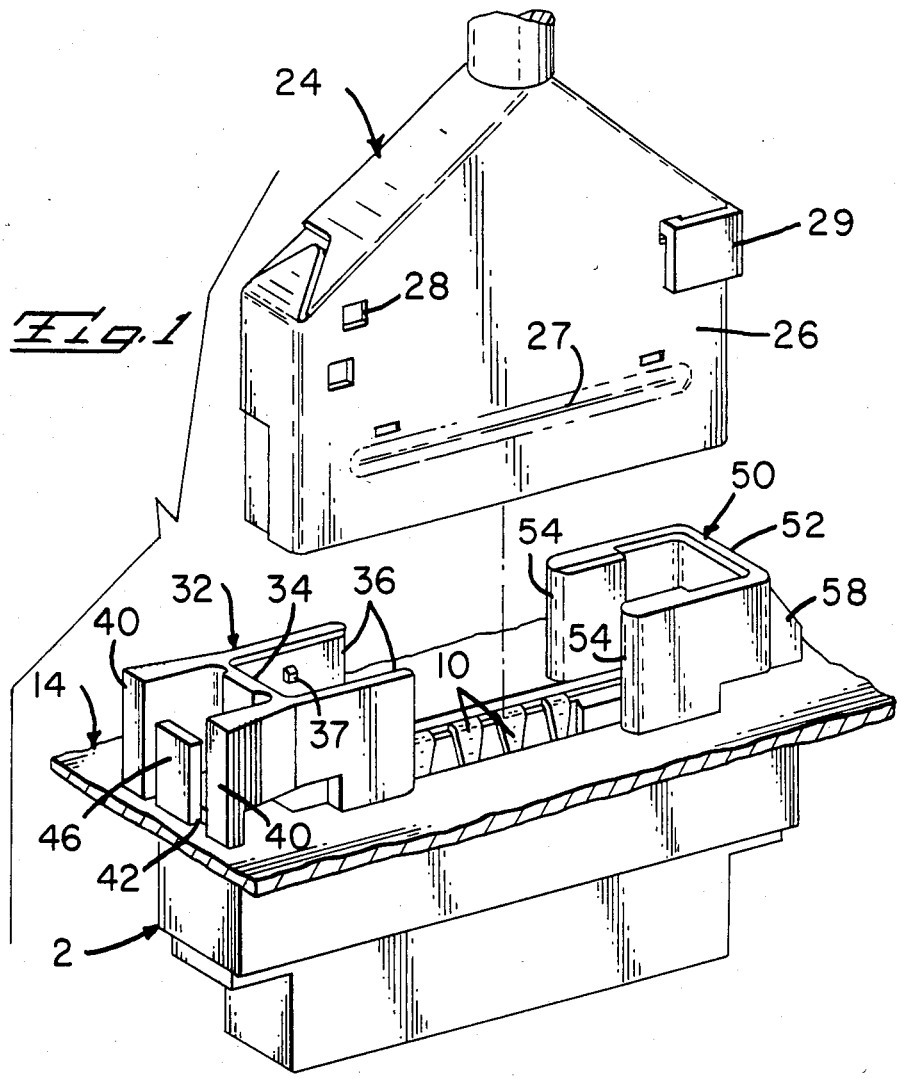
FIG. 1 is a perspective of the mating connector exploded from the assembled shroud.

Referring to FIG. 1, the shroud comprises a first shroud member 32 and a second shroud member 50, shown assembled to panel 14 to collectively define an elongate entry profiled to closely receive a mating connector 24. The first member 32 has an endwall 34 having a pair of parallel sidewalls 36 extending therefrom. Each sidewall 36 has an extension 40 extending freely from the opposite side of the endwall 34, which acts as a fulcrum when the extensions 40 are squeezed together so that sidewalls 36 move apart. A pedestal 42 extends from endwall 34 opposite sidewalls 36 for mounting flushly against panel 14. A stop 46 upstanding from the pedestal 42 prevents overstressing extensions 40. The second member 50 likewise has an endwall 52 with parallel sidewalls 54, but respective extensions 58 are offset from sidewalls 54 and integral with pedestal 60 to inhibit outward movement of sidewalls 54. The connector 24 has a stamped and formed metal shield 26 which is stamped with latching recesses 28 which are engaged by latches 37 on sidewalls 36, which recesses also serve to retain a snap-on polarization block 29. The shroud thus provides aligning, latching, and polarizing means for a connector 24 received in bulkhead connector or feed-through pin header 2 fixed to the opposite side of panel 14.

Figure 2:
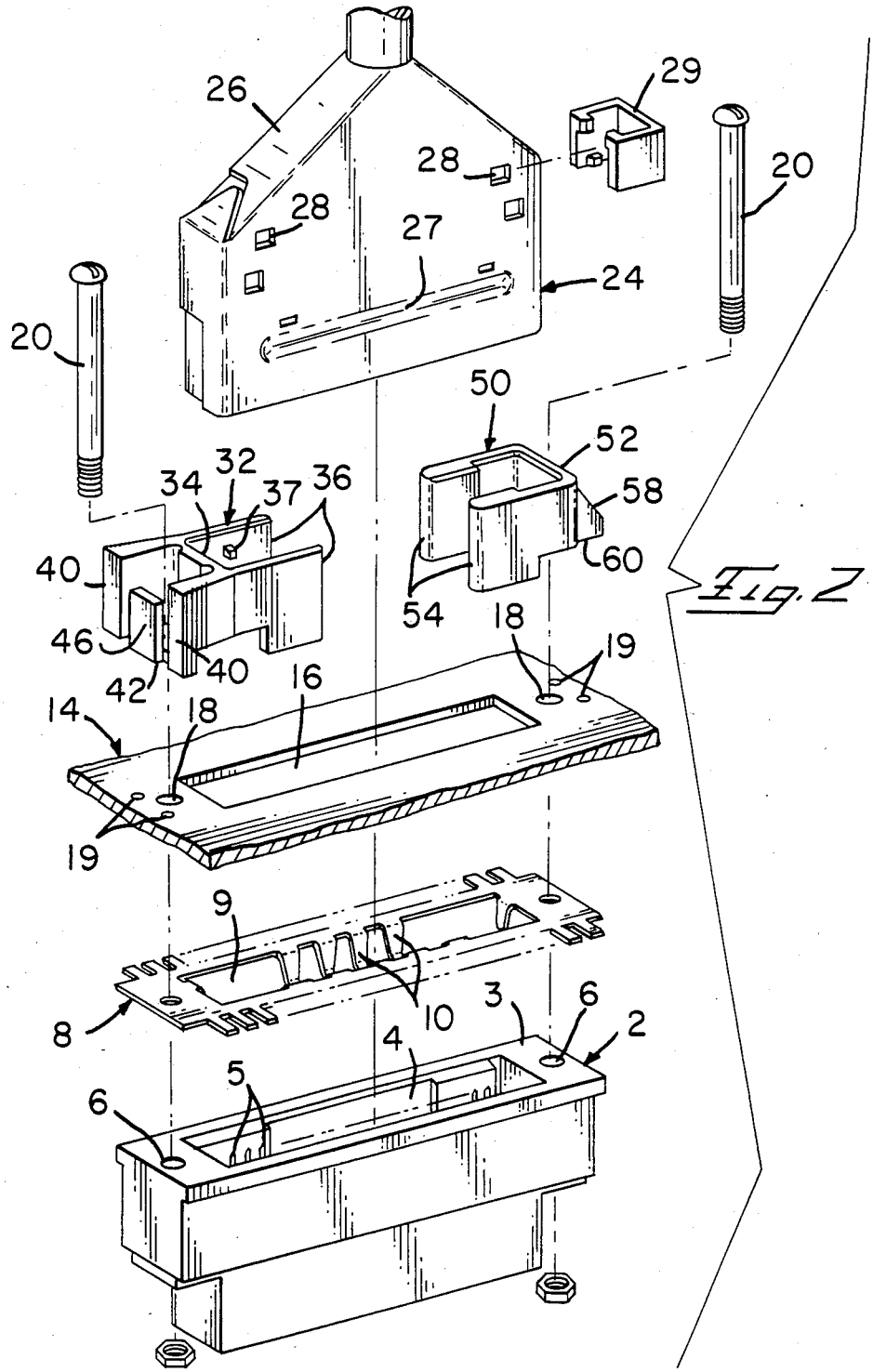
FIG. 2 is an exploded perspective of the shroud, panel, pin header, and mating connector.

Referring to FIG. 2, the pin header 2 comprises a dielectric housing 3 having a cavity 4 with an array of pins 5 therein. A typical header 2 has two rows of pins 5 on 0.100 in. centers; headers are available in a variety of sizes with up to thirty pins per row. The header 2 has holes 6 which align with holes 18 in panel 14 as cavity 4 is aligned with aperture 16 in the panel. A stamped and formed metal ground plane 8 is interposed between the header 2 and panel 14; the ground plane 8 has an aperture 9 flanked by resilient fingers 10 which extend into cavity 4. The panel 14 receives header 2 and ground plane 8 against one surface thereof and members 32, 50 against the other surface. Bolts 20 received through holes in the respective components serve to retain them together as a unit to receive mating connector 24. The metal shield 26 has an elongate stamped recess 27 in each opposed surface thereof, which recesses 27 are engaged by resilient fingers 10 when connector 24 is received in cavity 16.

Figure 3:
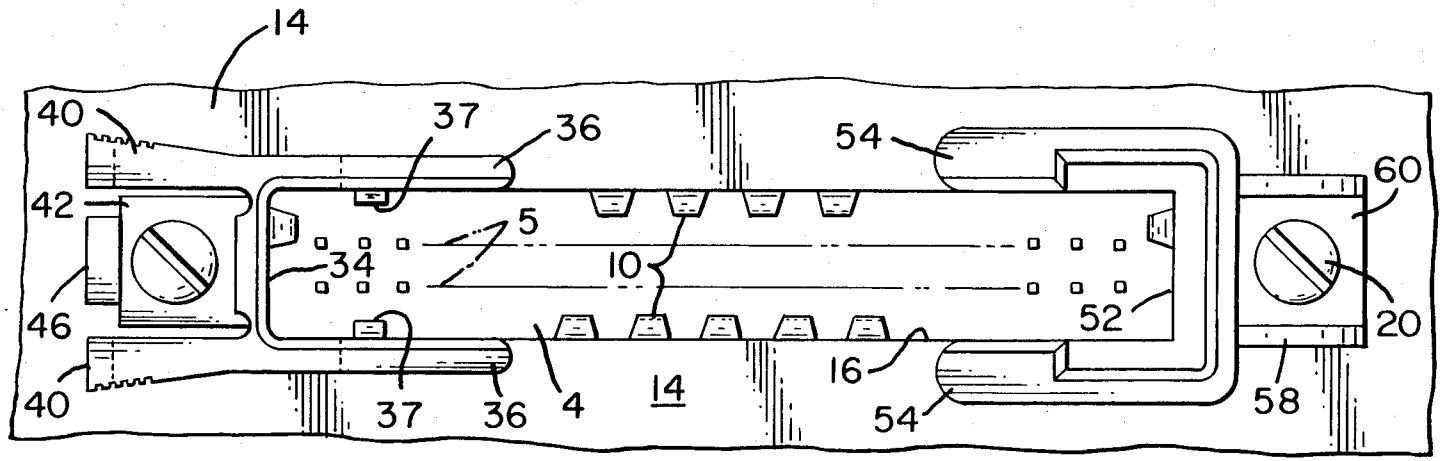
FIG. 3 is a plan view of the shroud members on the panel.

FIG. 3 shows the shroud members 32, 50 as bolted through respective pedestals 42, 60 to panel 14. The endwalls 34, 52 and sidewalls 36, 54 closely flank the aperture 16 so that a mating connector 14 (FIG. 1) received therein will be correctly aligned with the pins 5. The latches 37 overhang aperture 16 and interfere with reception of connector 24 to urge the sidewalls 36 apart until recesses 28 are engaged.

Figure 4:
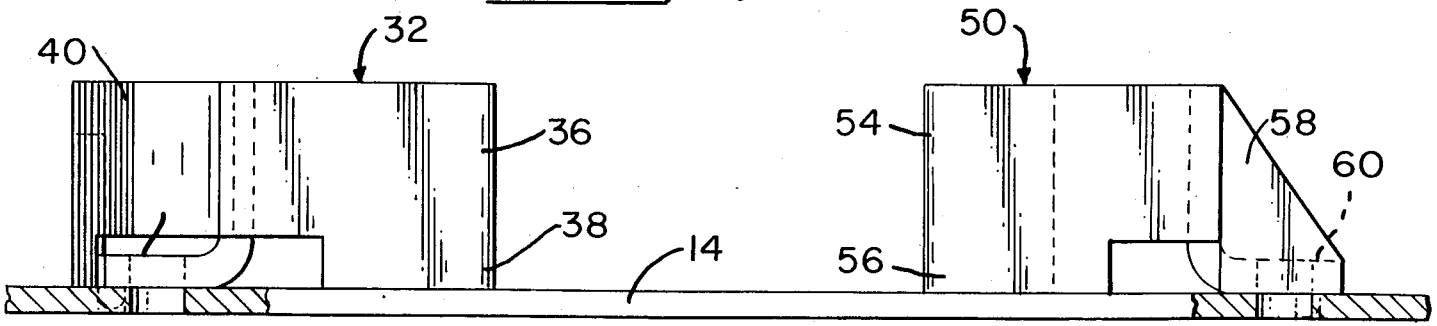
FIG. 4 is a side view of the shroud members on the panel.

FIG. 4 is a side view of the members 32, 50 positioned against panel 14 to header 2. The sidewalls 36 have standoffs 38 which abut panel 14 to prevent deflection theretoward during insertion of connector 24, and the sidewalls 54 have standoffs 56 which abut panel 14 for stability.

Figure 5:
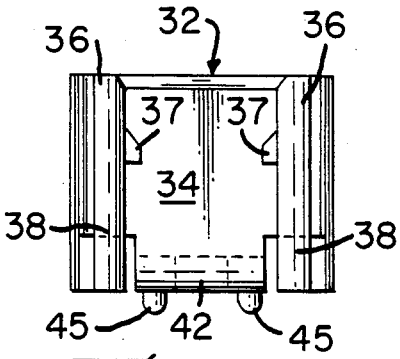
FIG. 5 is an end view of the first shroud member.
Figure 6:
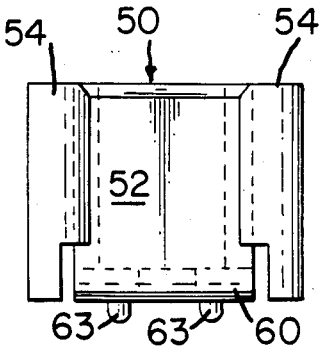
FIG. 6 is an end view of the second shroud member.

FIG. 5 shows the studs 45 which extend downward from pedestal 42 and are aligned for reception in holes 19, which assures proper alignment of first member 32 with panel 14. Note the ramped upper surfaces of latches 37, which serve to urge sidewalls 36 apart as mating connector 24 (FIG. 1) is received. FIG. 6 shows the studs 63 which extend downward from pedestal 60 to align second member 50 with panel 14.

The foregoing is exemplary and not intended to limit the scope of the claims which follow.

I claim:

1. A connector receiving shroud for fixing to a panel or the like, said shroud having an elongate entry profiled to closely receive a connector therein for alignment with an array of contacts fixed relative to said panel, said shroud being adapted for fixing about an elongate aperture in said panel, said entry being a through passage for access to contacts fixed in said aperture, said shroud comprising a first shroud member and a second shroud member, each member comprising an endwall and a pair of parallel sidewalls extending therefrom to define said passage, said sidewalls of said first member having means for latchably engaging said connector therebetween, said sidewalls of said first member acting as cantilevers movable relatively apart to release said engaging means, said sidewalls of said first member each having an opposed extension extending freely from said endwall opposite said entry, said endwall acting as a fulcrum whereby moving said extensions relatively together moves said sidewalls apart.

2. A shroud as in claim 1 wherein said second member is keyed to properly polarize a connector received in said passage for mating with contacts in said aperture.

3. A shroud as in claim 1 wherein each said endwall has a pedestal extending therefrom opposite said sidewalls for reception against said panel.

4. A shroud as in claim 1 wherein each said endwall has a pedestal extending therefrom opposite said sidewalls for reception against said panel, said pedestal on said first member having a stop upstanding therefrom between said extensions to limit movement together and prevent overstress.

5. Shroud means for use in conjunction with a panel adjacent an opening in the panel through which a section of a first electrical connector extends for electrical engagement with a second electrical connector which is securable onto the panel in alignment with the opening, said shroud means comprising:

first section means and second section means including end wall means and substantially parallel side wall means defining guide means outlining the opening to guide the section of the first electrical connector through the opening into electrical engagement with the second electrical connector;

mounting means for mounting said shroud means on the panel;

latch means on the side wall means of the first section means;

means provided by the side wall means of said first section means enabling the side wall means to move away from each other during insertion of the first electrical connector and to move back toward each other so that said latch means latch the first electrical connector in said shroud means; and extension means of the side wall means of said first section means for moving the side wall means away from each other, said extension means being cantilevered and extending from the side of the end wall means opposite the opening.

6. Shroud means as claimed in claim 5, and further including stop means on said first section means to limit movement of said extension means and prevent overstress thereof.

7. Shroud means as claimed in claim 5, wherein one of said section means includes key means to polarize the first electrical connector being received in said shroud means.

* * * * *